US006161726A

United States Patent [19]

Parsons et al.

[11] Patent Number: 6,161,726

[45] Date of Patent: Dec. 19, 2000

[54] PRESSURE-COMPENSATED LIQUID DISPENSER

[75] Inventors: Natan E. Parsons, Brookline, Mass.; Emanuel C. Ebner, Jr., Hudson, N.H.

[73] Assignee: Arichell Technologies, Inc., West Newton, Mass.

[21] Appl. No.: 09/220,425

[22] Filed: Dec. 24, 1998

[51] Int. Cl.[7] ..... B67D 5/08

[52] U.S. Cl. ..... 222/52; 222/504; 222/63; 222/181.3; 222/394

[58] Field of Search ..... 222/52, 504, 63, 222/181.2, 181.3, 394, 330; 137/614.2, 538

[56] References Cited

U.S. PATENT DOCUMENTS

| | | | |
|---|---|---|---|
| 3,073,490 | 1/1963 | Dahl et al. | 222/504 |
| 3,228,559 | 1/1966 | Couffer | 222/52 |
| 3,639,920 | 2/1972 | Griffin et al. | 4/166 |
| 3,712,512 | 1/1973 | Snider, Jr. et al. | 222/67 |
| 3,865,158 | 2/1975 | Withrow | 141/19 |
| 3,871,554 | 3/1975 | Huck | 222/96 |
| 4,136,802 | 1/1979 | Mascia et al. | 222/95 |
| 4,258,865 | 3/1981 | Vahl et al. | 222/213 |
| 4,431,117 | 2/1984 | Genbauffe | 222/3 |
| 4,484,695 | 11/1984 | Fallon | 222/23 |
| 4,557,728 | 12/1985 | Sealfon et al. | 604/134 |
| 4,722,372 | 2/1988 | Hoffman et al. | 141/98 |
| 4,781,689 | 11/1988 | Sealfon et al. | 604/134 |
| 4,946,070 | 8/1990 | Albert et al. | 222/52 |
| 4,946,072 | 8/1990 | Albert et al. | 222/105 |
| 4,991,742 | 2/1991 | Chang | 222/95 |
| 5,255,822 | 10/1993 | Mease et al. | 222/63 |
| 5,299,713 | 4/1994 | Saitoh | 222/51 |
| 5,323,932 | 6/1994 | Bauman | 222/96 |
| 5,356,051 | 10/1994 | Azuma et al. | 222/396 |
| 5,368,195 | 11/1994 | Pleet et al. | 222/52 |
| 5,397,028 | 3/1995 | Jesadanont | 222/52 |
| 5,398,845 | 3/1995 | Meyer | 222/1 |
| 5,556,005 | 9/1996 | Banks | 222/96 |
| 5,625,908 | 5/1997 | Shaw | 4/623 |
| 5,810,201 | 9/1998 | Besse et al. | 222/52 |

FOREIGN PATENT DOCUMENTS

| | | | |
|---|---|---|---|
| 2024788 | 3/1991 | Canada . | |
| 2720620 | 12/1995 | France . | |
| 3819412 A1 | 12/1989 | Germany | 222/504 |
| 4211494A1 | 10/1993 | Germany . | |
| 677092A5 | 4/1991 | Switzerland . | |
| 2284800A | 6/1995 | United Kingdom . | |

*Primary Examiner*—Kevin Shaver
*Assistant Examiner*—Melvin A. Cartagena
*Attorney, Agent, or Firm*—Cesari and McKenna, LLP

[57] ABSTRACT

An automatic soap dispenser (10) includes a disposable soap container including a dispensing mechanism (20) in which walls of an interior chamber (56) cooperate with a diaphragm (62) and a plunger (66) to form a transit chamber (64), which is resiliently expandable against the force of a spring (80). When a solenoid (58) permits the diaphragm (62) to move away from the outlet of a passage (50) in a flow path from the interior of a pressurized reservoir (18) to the expandable transit chamber (64), travel of the plunger (66) permits the transit chamber (64)'s pressure-relieving outlet opening to expand so that the pressure within the transit chamber (64) is determined predominantly by the force of the spring (80) rather than by the pressure within the reservoir (18). The velocity of the liquid dispensed from the transit chamber (64) through the dispensing mechanism's spout (16) is therefore relatively independent of the pressure within the reservoir (18).

54 Claims, 7 Drawing Sheets

PRESSURE-COMPENSATED LIQUID DISPENSER

BACKGROUND OF THE INVENTION

The present invention is directed to automatic liquid dispensing. It principally, but not exclusively, concerns dispensing of viscous materials such as liquid soap.

The conservation and sanitary advantages of automatic flow control in sink and similar installations is well known, and a large percentage of public rest-room facilities have provided automatic faucets and flushers as a result. There is a similar advantage to making liquid-soap dispensing automatic in such installations, but the popularity of doing so has not been great so far.

A significant part of the reason for this is installation difficulty. Installing the liquid-soap dispenser often requires providing extra wiring. A solution to this problem, which is to employ battery-operated systems as is now popular for retrofitting manual faucets to make them automatic, has heretofore involved problems of its own. In particular, the power required to pump liquid soap, which can be fairly viscous, is significant, so battery life would ordinarily be too short to be practical unless the batteries are excessively large.

SUMMARY OF THE INVENTION

We have recognized that this difficulty can largely be overcome by providing mechanical-powered reservoirs for soap or other (typically viscous) liquids. If a soap container is pre-loaded by, for instance, charging the liquid container with a pressurized gas, no electrical power is required to drive the fluid through the outlet; electrical power is necessary only for any automatic sensing and for operating a flow-controlling valve in response.

One would not ordinarily consider a gas-pressured container to be practical. If most of the container's volume is to be occupied by the liquid when it is initially sold, the pressure's dynamic range would be expected to be impracticably large: the velocity with which it expels soap would be too great from a full container and/or inadequate from one that is nearly empty. But we have solved this problem by dispensing the soap not directly from the pressurized reservoir but rather from a transit chamber that the reservoir feeds through a flow-resistant conduit. The transit chamber's outlet is so resiliently expandable in response to the transit-chamber pressure that the transit-chamber pressure—and thus the velocity of fluid leaving the spout—is relatively independent of the pressure in the liquid reservoir.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
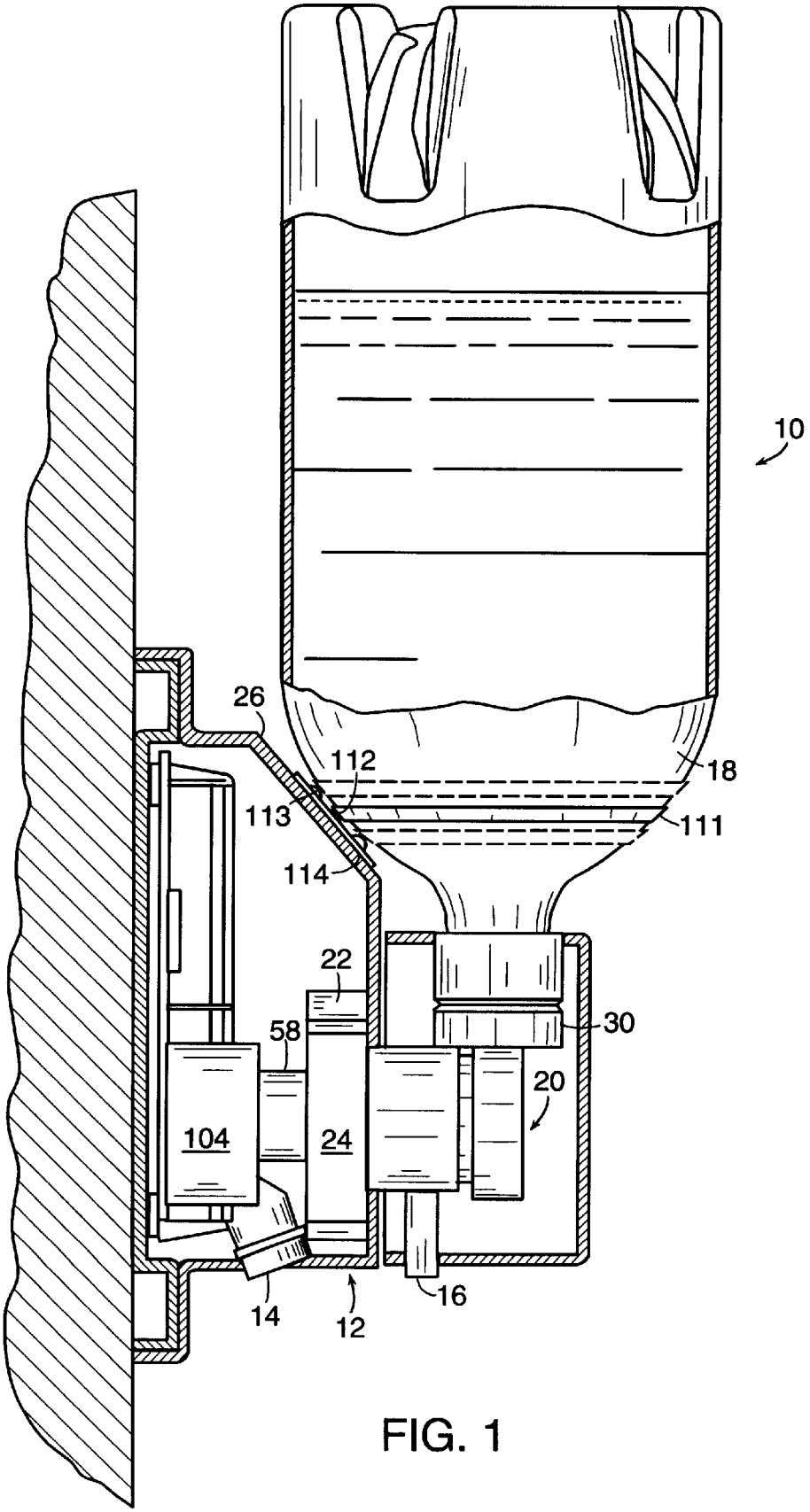
FIG. 1 is a side sectional view of a wall-mounted soap-dispenser, including a disposable soap container.

In FIG. 1, an automatic soap dispenser 10 includes a wall-mounted sensor-and-control assembly 12 including an object sensor 14 for detecting an object such as a user's hand under a spout 16 from which soap is to issue. In some embodiments the object sensors will simply respond whenever an object is present. In others the sensor will impose some criteria, such as object motion, that will tend to excfude unintended types of targets. Also, although other kinds may be employed, the sensor will most often be of the infrared or ultrasonic variety.

Ultrasonic varieties detect objects by transmitting ultrasound into the target region and sensing any resultant echo. Of the infrared varieties, some, "active" varieties shine infrared radiation into a target region and base their presence determinations on resultant reflections. Other, "passive" infrared systems do not shine radiation into the target region. They base their determinations on radiation that objects emit or reflect naturally.

The spout 16 is part of a disposable soap-supply unit that includes a reservoir-forming container 18 together with a dispensing mechanism 20 that implements the present invention's teachings. In one embodiment, the reservoir is charged with a high-pressure gas, typically nitrogen. Pressures and volumes will vary from model to model, but in one example the gas exerts a pressure of 60 psi at 20° C. and occupies 0.75 liter of a 1.75 liter reservoir when the container is initially installed. As soap is withdrawn, the gas volume increases, so the pressure falls, reaching approximately 6 psi before the soap supply is exhausted. Other designs may allow the pressure to fall lower, to, say, 3 psi.

To mount the soap-supply unit in the sensor-and-control assembly 12, the installer holds the container 18 with its longitudinal axis at an angle to the vertical so that, as will be explained in more detail below, tabs 22 on the dispensing mechanism's locking collar 24 are aligned with mating recesses (not shown in FIG. 1) in the front wall of a sensor-system housing 26. The installer then locks the container in place by rotating it so that the tab and recesses are no longer aligned.

Although the disposable unit in the illustrated embodiment includes not only the container 18 but also the dispensing mechanism 20, it will become apparent that the present invention's teachings can be employed in systems in which the dispensing mechanism is permanently mounted in the sensor-and-control assembly 12 and only the soap-supply and container is replaced. Indeed, a permanently mounted, refillable container could be used. The dispensing mechanism's operation would be essentially the same in all cases.

Figure 2:
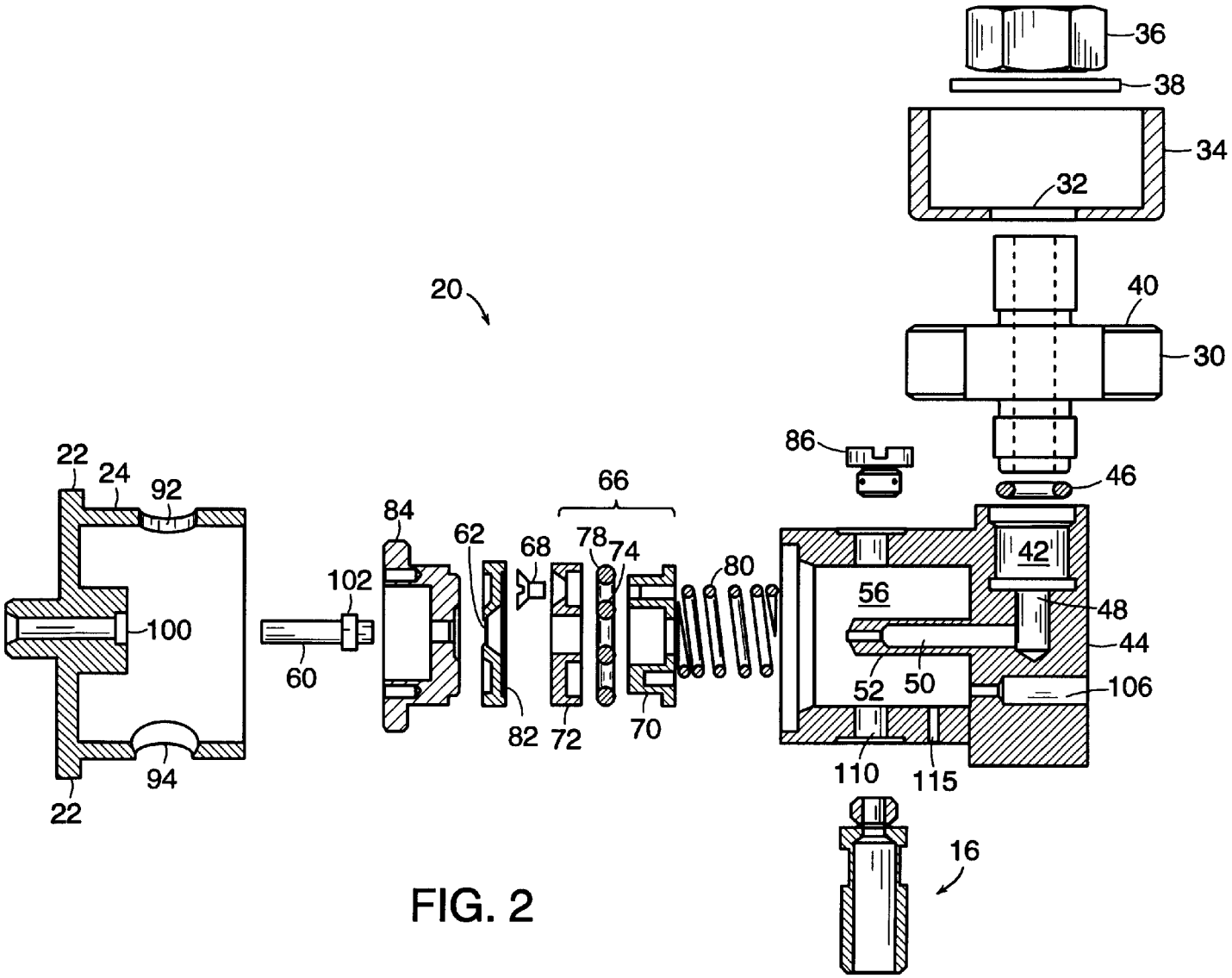
FIG. 2 is an exploded view of the disposable container's dispensing mechanism.
Figure 3:
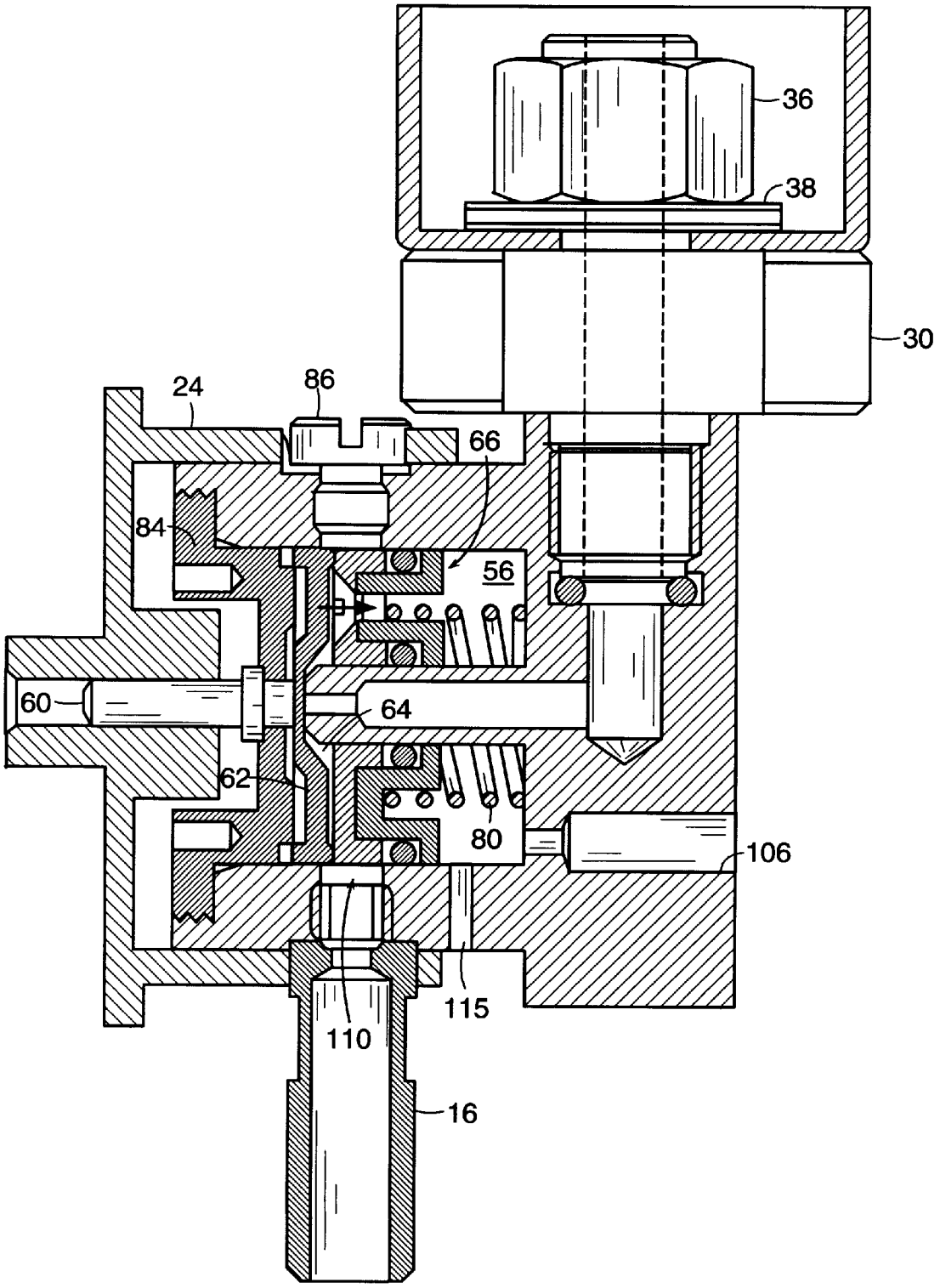
FIG. 3 is an assembled view of the same mechanism in its operative state.

To explain how the dispensing mechanism operates, we turn to FIGS. 2 and 3, which respectively depict it in exploded and assembled views. An adapter member 30 providing an internal passageway 32 extends through a cap 34 that threadedly-engages the main reservoir body. A nut 36 threadedly engages the adapter 30's upper narrowed extension so as to bear against a washer 38 and thereby secure the cap 34 against the adapter's shoulder 40. Internal threads in a recess 42 that a housing member 44 provides engage corresponding threads on the adapter 30's lower narrowed extension, which thereby bears against an O-ring seal 46 to prevent leakage through the recess 42.

Passage 32 communicates with a second passage 48 formed by a thickened part of the housing 44, which in turn communicates with a third passage 50 formed by the housing's protrusion 52 into a cylindrical chamber 56 that the housing 44 forms. These three passages together form a conduit through which a solenoid 58 controls flow. Specifically, the solenoid's spring-loaded armature (not shown) ordinarily bears against a diaphragm actuator 60 and thereby holds a diaphragm 62's central portion in a valve seat that the protrusion 52 forms at the left end. The solenoid 58 is preferably of the latching variety, which requires power to change between a retracted state and the illustrated extended state but not to remain in either state. So it cooperates with the actuator, diaphragm, and valve seat to act as a latching valve.

When the solenoid 58 is operated to its retracted state, its armature no longer holds the actuator 60 against the diaphragm. Conduit pressure thereupon unseats the diaphragm 62 so that the soap can flow from the reservoir through the conduit to a transit chamber 64 that the diaphragm 62 and the chamber 56's walls form with a movable plunger 66.

A flat-head screw 68 causes the plunger's right and left halves 70 and 72 to squeeze inner and outer O-rings 74 and 78 between them. The inner O-ring 74 provides a seal between the plunger and protrusion 52, while the outer O-ring 78 provides a seal between the plunger and the chamber 56's circumferential wall. When the valve is closed, a spring 80 holds the plunger 66 against circumferential outer land 82 on the diaphragm 62.

Figure 4:
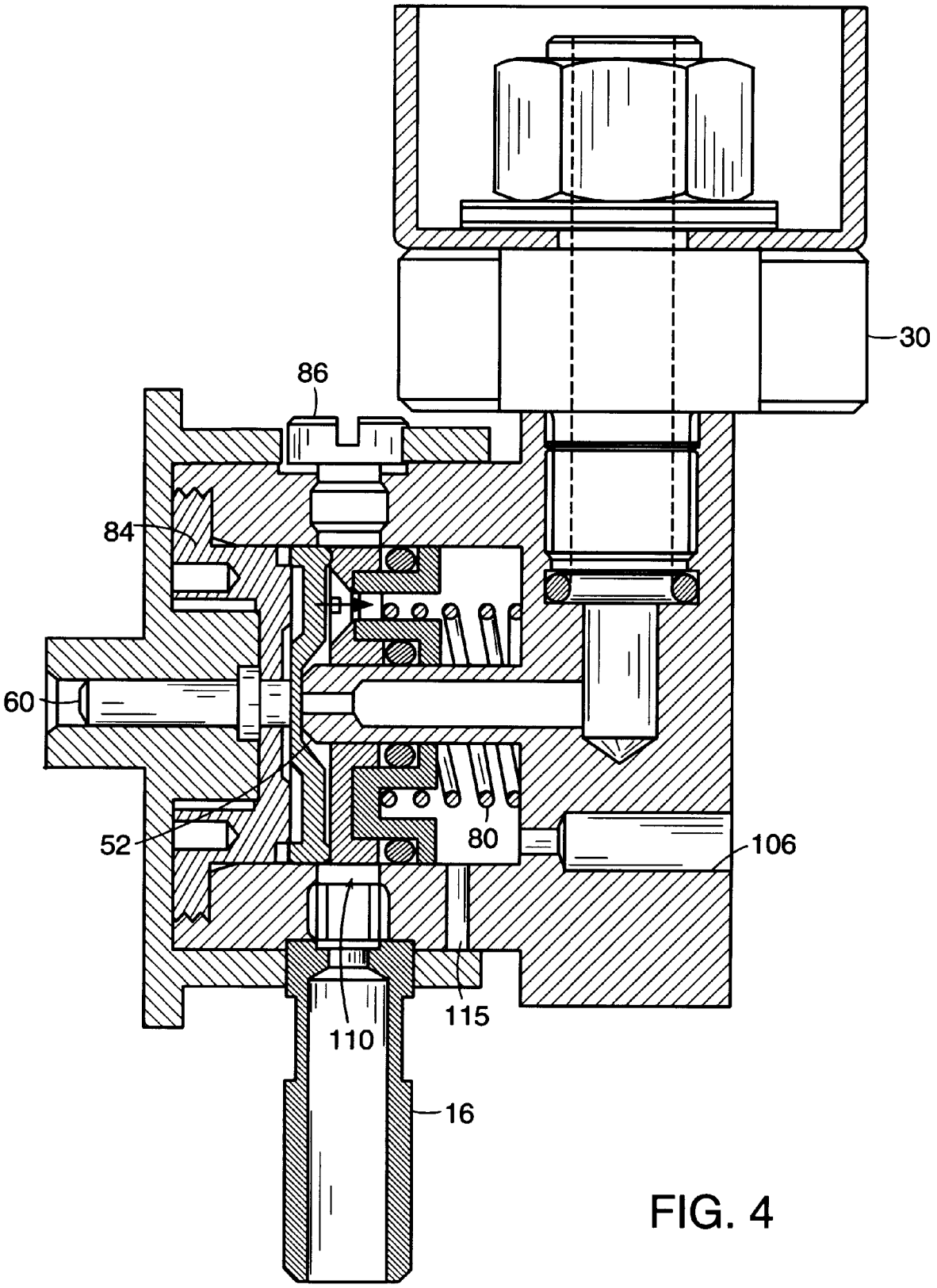
FIG. 4 is an assembled view of the same mechanism in its locked state.

A diaphragm retainer 84 threadedly secured in the housing 44's inferior holds the diaphragm in place. A locking pin 86 and the spout 16, which are both secured in the housing 44, engage the locking collar 24's cam surfaces 92 and 94. These surfaces are so angled that rotating the locking collar with respect to housing member 44 causes the locking collar to translate rightward to the FIG. 4 position, in which a counterbore surface 100 engages a collar 102 formed on the actuator and thereby keeps the diaphragm 62 in sealing engagement with the protrusion 52. This feature keeps the disposable container from leaking during shipping, when no solenoid armature bears against the actuator 60.

Before installation, the locking collar 24 is rotated in the other direction so that surface 100 is spaced from the actuator collar 102 as FIG. 3 illustrates, and the actuator 60 can therefore travel to the left when, upon sensor 14's detection of an object meeting certain criteria below the spout 16, a control circuit 104 operates the solenoid 58 to withdraw the spring-loaded armature. In that position, the armature allows pressurized fluid from passage 50 to urge the actuator 60 leftward and flow into the transit chamber 64. The resultant transit-chamber pressure causes the plunger 66 to withdraw to the right against the force of the spring 80, expelling air through a vent 106 and opening a clearance between the plunger and the diaphragm land 82. The clearance permits fluid to flow through an outlet passage 110 to the spout 16. In some embodiments, the liquid soap may be converted to a foam as it is thus being dispensed.

The resultant amount of liquid soap dispensed should be relatively repeatable, so the control circuit closes the valve automatically after the predetermined duration. The control circuit increases this predetermined duration with each use to compensate for the fact that the volume flow rate through the spout decreases, as will be explained presently, in response to the declining reservoir pressure. When an empty container is removed, an annular rib 111 on the container releases a membrane switch 112 and thereby alerts the control circuit to the container's replacement. The control circuit accordingly resets the valve-opening duration to an initial, low value when a full container's locking collar thereafter engages the microswitch.

It may be desirable in some installations to permit different-sized containers to be installed in the same sensor-and-control assembly. In such installations, the initial value of valve-opening duration will depend on container size. For this reason, annular ribs on different-sized containers will engage different ones of a plurality of membrane switches 112, 113 and 114 to tell the control circuit what the container's size is.

In the absence of the resilient expandability that the movable spring-loaded plunger 66 affords the transit chamber 64, the pressure that expels the soap through the spout would be excessive when the reservoir is full and/or insufficient when it is nearly empty. But chamber 64's resilient expandability reduces that pressure's dependence on the reservoir 18's gas pressure, as will now be explained.

The pressurized container pressurizes the transit chamber 64 when the valve opens. The resulting force against the plunger 66 tends to move the plunger to the right against the spring 80's force, which is thus proportional to chamber pressure. The plunger's left edge moves from the edge of the outlet passage 110's circular cross section toward its center. So a small-percentage change in chamber pressure, which is proportional to spring force, results in a large-percentage opening-size increase. Since this opening increase occurs against a restoring force, we refer to the transit-chamber outlet as "resiliently expandable."

The large opening increase permits the volume flow rate out of the transit chamber 64 to increase significantly. But that increase results in a corresponding increase in the flow into the transit chamber through passage 50's flow resistance, so the pressure drop through that passage increases and tends to lower the transit-chamber pressure that counteracts spring 80's leftward force. Because of this negative-feedback mechanism, the equilibrium plunger position—and thus the compression of the spring 80—varies only slightly despite a wide reservoir-pressure variation. Since the transit-chamber pressure is determined by spring 80's force, it, too, is relatively insensitive to reservoir pressure, so the force with which the system ejects soap is not objectionably variable.

Chamber 56 is long enough that plunger 66 does not ordinarily reach that chamber's right wall before the valve closes and the spring 80 returns the plunger 66 to its rest position. If the plunger 66 does reach the wall, though, it will also clear an over-pressure port 115, which thereby provides another soap outlet and reduces the excess pressure within the transit chamber 64.

To enable their customers to employ liquid-soap containers of the illustrated type, which include dispensing mechanisms to moderate velocity variations in the dispensed liquid, soap distributors may give their customers the sensor-and-control assembly without charging them for it. This has the beneficial effect of allocating risk to the party that has the greater knowledge: if the buyer is not satisfied with such containers'performance, the buyer can simply discontinue their use after having bought only one or a very few such containers, and the buyer's risk is limited to the cost of the initial soap-container supply. The cost of the sensor-and-control assembly is borne by the distributor, who presumably is familiar with this product should be confident enough in its performance to take the risk that the buyer will not be satisfied with the product.

But there is an additional risk, one that the distributor is typically not willing to bear. Specifically, the buyer may in fact like the product but end up using a different distributor's soap in the sensor-and-control mechanism given him by the first distributor. To avoid this problem, the container manufacturer can key containers to sensor-and-control assemblies in such a manner that a sensor-and-control assembly sold to a given distributor will work only with containers sold to the same distributor.

Figure 7:
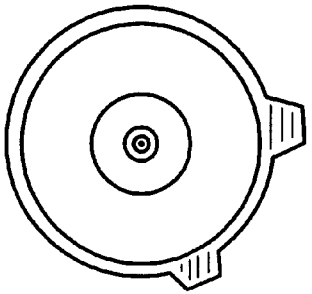
FIG. 7 is a front elevation of an alternate embodiment of the dispensing mechanism's locking collar.
Figure 6:
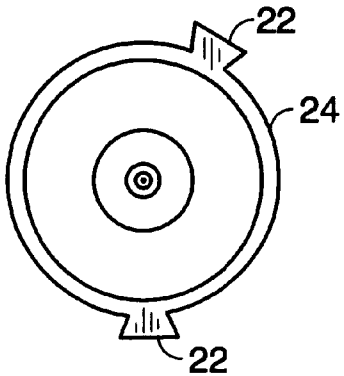
FIG. 6 is a front elevation of the dispensing mechanism's locking collar.
Figure 5:
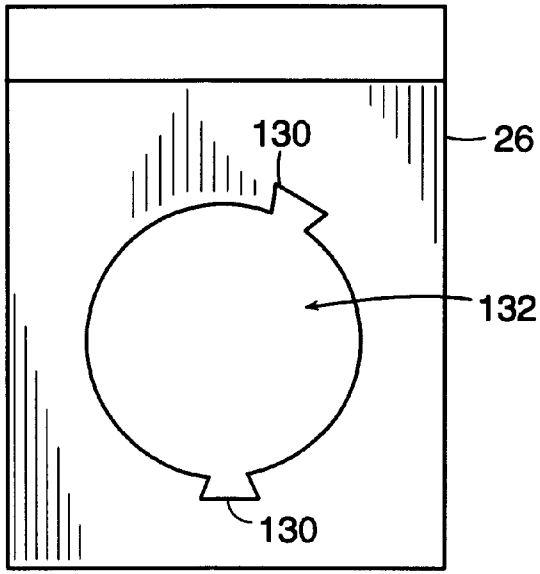
FIG. 5 is a front elevation of the housing of the soap dispenser's sensor-and-control assembly.

FIGS. 5 and 6, which are side elevational views of the sensor-and-control assembly's housing 26 and the container's locking collar 24, respectively, illustrate this feature. FIG. 6 depicts the locking collar 24 in the orientation that it assumes when the container is in its normal, upright orientation and its tabs 22 are not in alignment with recesses 130 that extend from the opening 132 into which the locking collar 24 fits. But it is also apparent that FIG. 6's tabs 22 register with those recesses 130 when the container is properly tilted for installation. As FIG. 7 illustrates, though, a container made for a different supplier can have tabs that have a different angular displacement and/or a different shape so that they cannot be installed in the sensor-and-control assemblies that the manufacturer sells to a different supplier.

Figure 8:
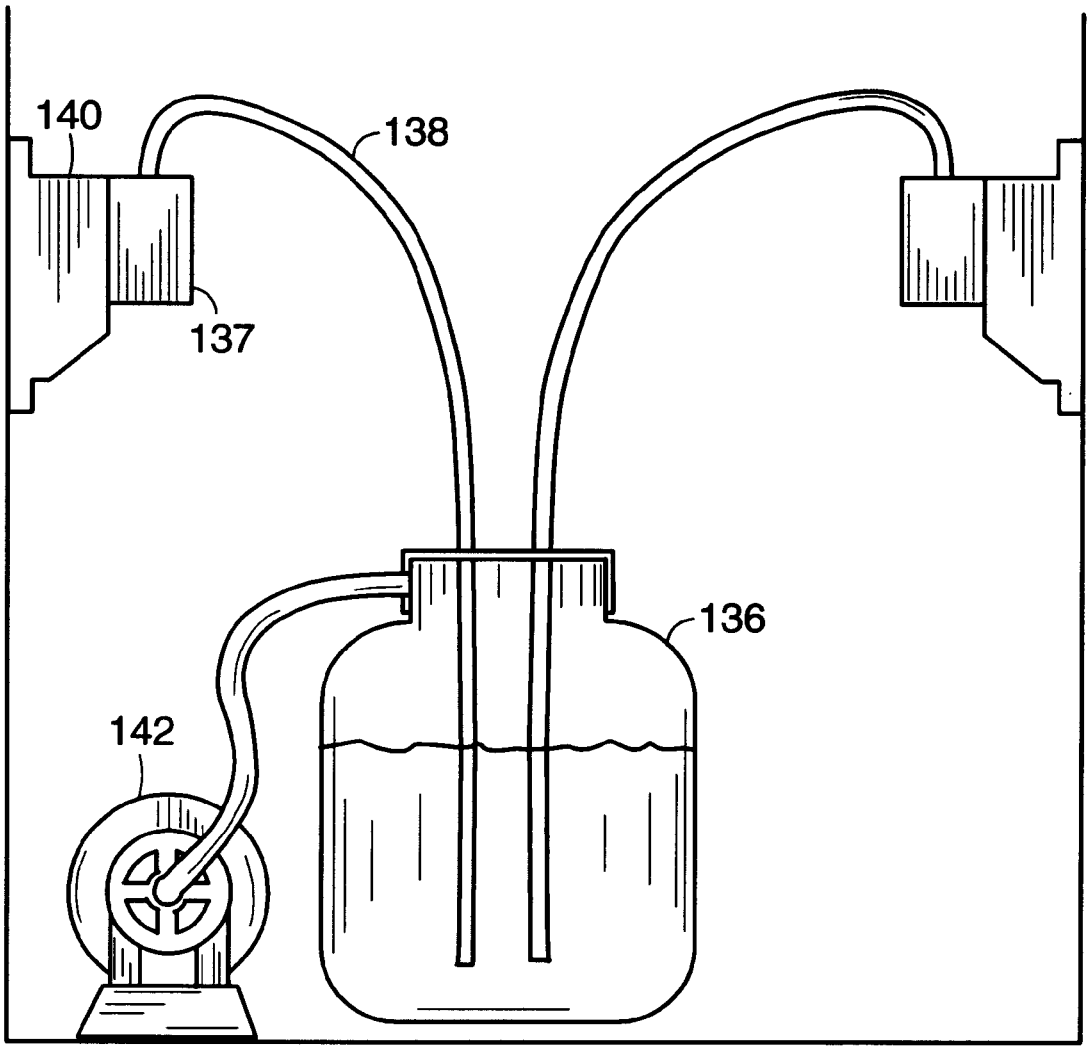
FIG. 8 is an elevational view of an alternative soap-dispensing system that employs the present invention's teachings.

The present invention's teachings can be implemented in a wide range of embodiments. For example, a container 136 in the arrangement depicted in FIG. 8 feeds a remote dispensing mechanism 137 through a long tube 138. In this case, the dispensing mechanism is permanently mounted on the sensor-and-control assembly 140 and thus does not have to be replaced when the container 136 is empty. Additionally, FIG. 8 shows that a common container 136 can supply a plurality of installations, and it does not have to be oriented with its outlet on the bottom, as it is in FIG. 1.

Although the pressure that drives this remote-supply arrangement can be supplied by an initial charge of pressurized gas, some installations will instead provide the pressurized gas from a common plant pressurized-air source 142, which typically includes its own pressure regulator. In such a situation the transit-chamber feature would compensate only for pressure variations that arise from changes in the container's liquid soap depth. If the container is not large, such compensation may not be needed.

The present invention's teachings are not limited to gas-pressurized reservoirs in which a gas pressurizes the liquid. In an embodiment that FIGS. 9 and 10 depict, for example, the reservoir is provided by a bellows-type collapsible container 144, which constant-force springs 146 and 148 wrapped about wall-mounted dowels 150 and 152 compress to provide the necessary pressure.

Figure 10:
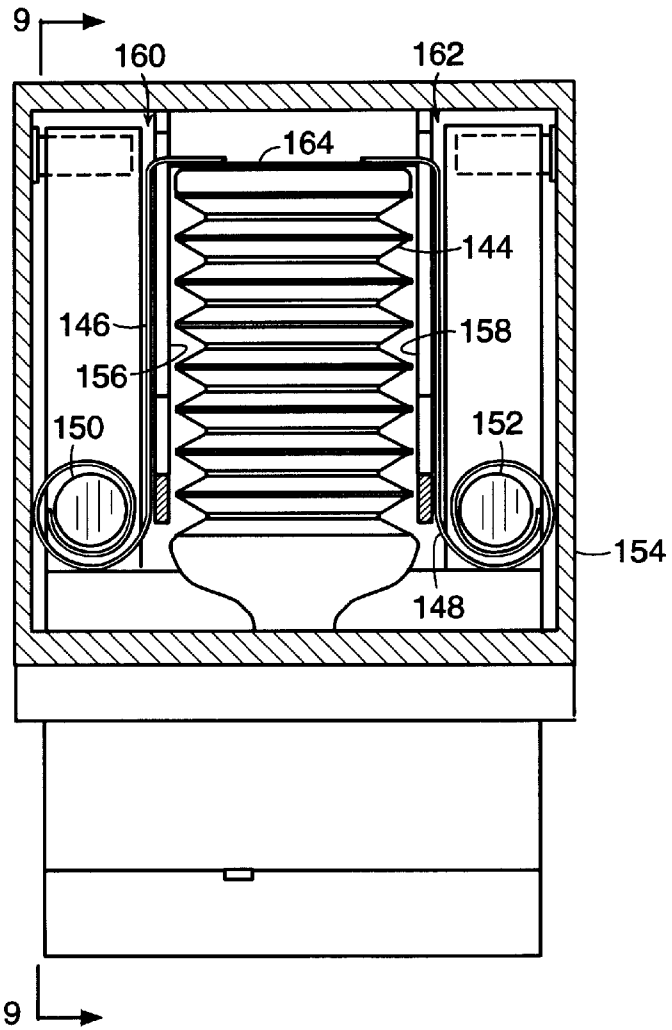
FIG. 10 is a side elevation of the FIG. 9 embodiment.
Figure 9:
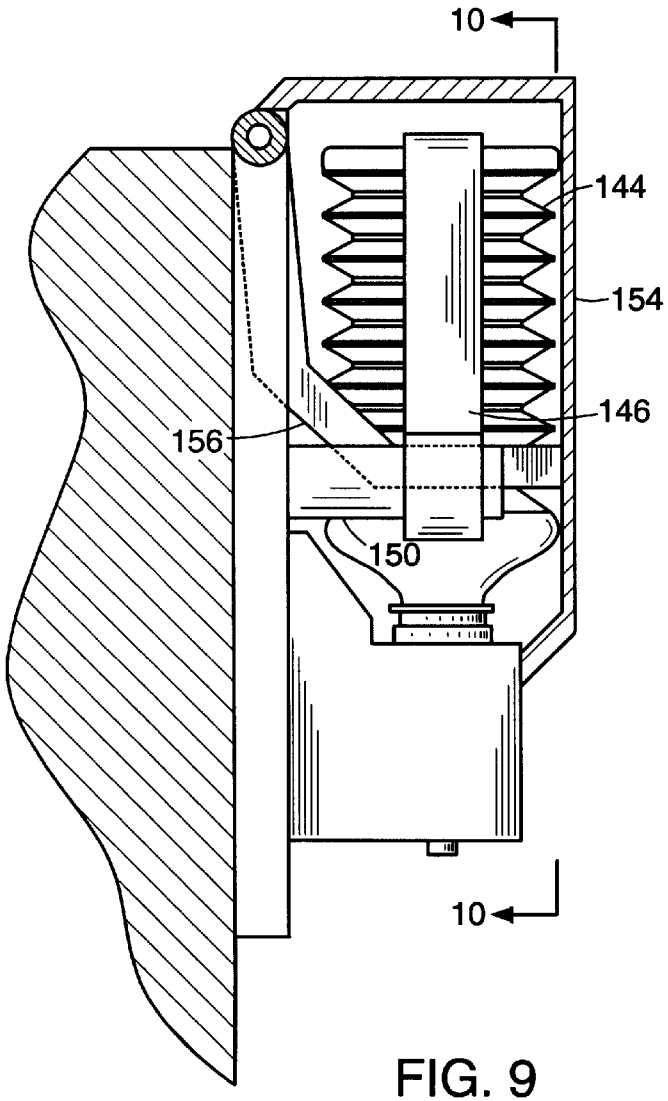
FIG. 9 is a side elevation of an alternative embodiment of the disposable container.

FIGS. 9 and 10 show the dispenser in its normal state, in which a cover 154 encloses the container 144. To replace the container 144, the cover 154 is first opened. In the process, it raises internal arms 156 and 158. Those arms thereupon engage the springs 146 and 148 under shoulder portions 160 and 162 and lift them and a connector plate 164 out of contact with the container. The container is thereby free to be removed. After the replacement container has been mounted, the cover is returned to the illustrated position, in which the springs apply force to the new container.

Actually, the force applied by these "constant-force" springs varies by a small amount as the container collapses. So long as the spring force varies by less than about 20% between the bellows-type container's expanded and compressed positions, though, the transit-chamber feature described above is unnecessary. But the present invention's teachings make it practical to use more-common springs, which have more-nearly Hooke's-law relationships between force and displacement.

By thus making a battery-operated soap dispenser practical, the present invention paves the way for much greater acceptance of this health-and-conservation measure. It thus constitutes a significant advance in the art.

What is claimed is:

1. A fluid-dispensing system including:

A) a container forming a reservoir for a pressurized fluid; and

B) at least one flow controller, each of which comprises:

i) a conduit forming a flow-resistant passage that communicates with the interior of the reservoir;

ii) an electric valve operable by application of control signals thereto to control fluid flow through the conduit; and iii) a transit-chamber assembly forming a transit chamber into which the conduit provides fluid communication from the reservoir's interior when the valve is open, the transit chamber having a transit-chamber outlet resiliently expandable in response to pressure so as to reduce the transit-chamber pressure's dependence on the pressure in the reservoir.

2. A fluid-dispensing system as defined in claim 1 including a plurality of said flow controllers.

3. A fluid-dispensing system as defined in claim 1 wherein the transit-chamber assembly includes a chamber-forming housing and spring-loaded plunger movable within the housing to form one wall of the transit chamber.

4. A fluid-dispensing system as defined in claim 3 including a plurality of said flow controllers.

5. A fluid-dispensing system as defined in claim 3 wherein the transit-chamber assembly further includes a diaphragm that forms another wall of the transit chamber.

6. A fluid-dispensing system as defined in claim 5 wherein the valve includes:

A) a valve seat formed on the conduit; and

B) a valve member comprising a portion of the diaphragm that is movable between a seated position, in which it is in sealing contact with the valve seat so as to prevent fluid flow through the conduit, and an unseated position, in which it permits fluid flow through the conduit.

7. A fluid-dispensing system as defined in claim 6 wherein the electric valve includes a solenoid operable by application of the control signals thereto between an extended state, in which it keeps the valve member in its seated position, and a retracted state, in which it permits the valve member to assume its unseated position.

8. A fluid-dispensing system as defined in claim 7 wherein the solenoid is a latching solenoid, which requires power to switch between its extended and retracted states but not to remain in either state.

9. A fluid-dispensing system as defined in claim 8 wherein:

A) the electric valve further includes a valve actuator; and

B) the solenoid includes an armature that so urges the valve actuator against the valve member when the solenoid is in its extended state as to hold the valve member in its seated position.

10. A fluid-dispensing system as defined in claim 8 wherein the flow controller further includes a sensor circuit operable to sense the presence of objects in a target region and apply the control signals to the electric valve to control flow of fluid through that flow controller's conduit in response to at least one predetermined characteristic of the sensed object.

11. A fluid-dispensing system as defined in claim 7 wherein:

A) the electric valve further includes a valve actuator; and

B) the solenoid includes an armature that so urges the valve actuator against the valve member when the solenoid is in its extended state as to hold the valve member in its seated position.

12. A fluid-dispensing system as defined in claim 7 wherein each flow controller further includes a sensor circuit operable to sense the presence of objects in a target region and apply the control signals to the electric valve to control flow of fluid through that flow controller's conduit in response to at least one predetermined characteristic of the sensed object.

13. A fluid-dispensing system as defined in claim 5 wherein the housing forms a spout opening partially covered by the plunger to form therewith the transit-chamber opening, which thereby varies in size as the plunger travels.

14. A fluid-dispensing system as defined in claim 3 wherein the housing forms a spout opening partially covered by the plunger to form therewith the transit-chamber opening, which thereby varies in size as the plunger travels.

15. A fluid-dispensing system as defined in claim 14 including a plurality of said flow controllers.

16. A fluid-dispensing system as defined in claim 1 wherein the electric valve includes:

A) a valve seat;

B) a valve member operable between a seated position, in which it prevents fluid flow through the conduit, and an unseated position, in which it permits fluid flow through the conduit; and C) a solenoid operable by application of the control signals thereto between an extended state, in which it keeps the valve member seated in the valve seat, and a retracted state, in which it permits the valve member to assume its unseated position.

17. A fluid-dispensing system as defined in claim 16 including a plurality of said flow controllers.

18. A fluid-dispensing system as defined in claim 16 wherein the solenoid is a latching solenoid, which requires power to switch between its extended and retracted states but not to remain in either state.

19. A fluid-dispensing system as defined in claim 18 wherein:

A) the electric valve further includes a valve actuator; and

B) the solenoid includes an armature that so urges the valve actuator against the valve member when the solenoid is in its extended state as to hold valve member in its seated position.

20. A fluid-dispensing system as defined in claim 18 wherein the flow controller further includes a sensor circuit operable to sense the presence of objects in a target region and apply the control signals to the electric valve to control flow of fluid through that flow controller's conduit in response to at least one predetermined characteristic of the sensed object.

21. A fluid-dispensing system as defined in claim 16 wherein:

A) the electric valve further includes a valve actuator; and

B) the solenoid includes an armature that so urges the valve actuator against the valve member when the solenoid is in its extended state as to hold it seated in its seated position.

22. A fluid-dispensing system as defined in claim 16 wherein the flow controller further includes a sensor circuit operable to sense the presence of objects in a target region and apply the control signals to the electric valve to control flow of fluid through that flow controller's conduit in response to at least one predetermined characteristic of the sensed object.

23. A fluid-dispensing system as defined in claim 3 wherein the flow controller further includes a sensor circuit operable to sense the presence of objects in a target region and apply the control signals to the electric valve to control flow of fluid through that flow controller's conduit in response to at least one predetermined characteristic of the sensed object.

24. A fluid-dispensing system as defined in claim 23 including a plurality of said flow controllers.

25. A fluid-dispensing system as defined in claim 23 wherein the sensor circuit includes an infrared object detector.

26. A fluid-dispensing system as defined in claim 25 wherein the infrared object detector is an active infrared object detector.

27. A fluid-dispensing system as defined in claim 25 wherein the infrared object detector is a passive infrared object detector.

28. A fluid-dispensing system as defined in claim 23 wherein the sensor circuit includes an ultrasonic object detector.

29. A fluid-dispensing system as defined in claim 1 wherein the container contains a liquid and a pressurized gas that tends to expel the liquid through the conduit.

30. A fluid-dispensing system as defined in claim 29 including a plurality of said flow controllers.

31. A fluid-dispensing system as defined in claim 29 wherein the liquid consists essentially of liquid soap.

32. A fluid-dispensing system as defined in claim 29 wherein the pressure of the pressurized gas exceeds ambient by at least three pounds per square inch.

33. A fluid-dispensing system as defined in claim 29 wherein each conduit provides the only fluid communication with the interior of the container.

34. A fluid-dispensing system as defined in claim 1 wherein the container is collapsible and the system further includes a spring so mounted as to tend to collapse the container and expel the liquid through the conduit.

35. A fluid-dispensing system comprising:

A) a container forming a liquid reservoir that contains a liquid and a pressurized gas; and B) a plurality of flow controllers, each of which comprises:

i) a conduit that so communicates with the interior of the reservoir that the pressurized gas tends to urge the liquid through the conduit;

ii) an electric valve operable by application of control signals thereto to switch between an open state, in which the valve permits fluid flow through the conduit, and a closed state, in which it prevents fluid flow through the conduit; and iii) a sensor circuit operable to sense the presence of objects in a target region and apply control signals to control flow of liquid through the conduit in response to at least one predetermined characteristic of the sensed object.

36. A fluid-dispensing system as defined in claim 35 wherein the liquid consists essentially of liquid soap.

37. A fluid-dispensing system as defined in claim 35 wherein the pressure of the pressurized gas exceeds ambient by at least three pounds per square inch.

38. A fluid-dispensing system as defined in claim 37 wherein the liquid consists essentially of liquid soap.

39. A fluid-dispensing system as defined in claim 37 wherein the sensor circuit includes an ultrasonic object detector.

40. A fluid-dispensing system as defined in claim 37 wherein the sensor circuit includes an infrared object detector.

41. A fluid-dispensing system as defined in claim 40 wherein the infrared object detector is an active infrared object detector.

42. A fluid-dispensing system as defined in claim 40 wherein the infrared object detector is a passive infrared object detector.

43. A fluid-dispensing system as defined in claim 35 wherein each conduit provides the only fluid communication with the interior of the container.

44. A fluid-dispensing system as defined in claim 43 wherein the liquid consists essentially of liquid soap.

45. A fluid-dispensing system as defined in claim 43 wherein the pressure of the pressurized gas exceeds ambient by at least three pounds per square inch.

46. A fluid-dispensing system as defined in claim 45 wherein the liquid consists essentially of liquid soap.

47. A fluid-dispensing system comprising:

A) a container forming a liquid reservoir that contains a liquid and a pressurized gas;

B) at least one flow controller, each of which comprises:

i) a conduit that so communicates with the interior of the reservoir that the pressurized gas tends to urge the liquid through the conduit;

ii) an electric valve operable by application of control signals thereto to switch between an open state, in which the valve permits fluid flow through the conduit, and a closed state, in which it prevents fluid flow through the conduit; and iii) a sensor circuit operable to sense the presence of objects in a target region and apply control signals to control flow of liquid through the conduit in response to at least one predetermined characteristic of the sensed object; and C) a pressurized-gas source external to the liquid reservoir and so communicating with the reservoir interior as to supply the pressurized gas that tends to urge the liquid through the conduit.

48. A fluid-dispensing system as defined in claim 47 including a plurality of said flow controllers.

49. A fluid-dispensing system as defined in claim 48 wherein the liquid consists essentially of liquid soap.

50. A fluid-dispensing system as defined in claim 47 wherein the liquid consists essentially of liquid soap.

51. A fluid-dispensing system as defined in claim 47 wherein the pressure of the pressurized gas exceeds ambient by at least three pounds per square inch.

52. A fluid-dispensing system as defined in claim 51 including a plurality of said flow controllers.

53. A fluid-dispensing system as defined in claim 52 wherein the liquid consists essentially of liquid soap.

54. A fluid-dispensing system as defined in claim 51 wherein the liquid consists essentially of liquid soap.

* * * * *